US005350889A

United States Patent [19]

Lauritsen

[11] Patent Number: 5,350,889

[45] Date of Patent: Sep. 27, 1994

[54] MULTIPLE CIRCUIT SWITCHING ASSEMBLY

[75] Inventor: Richard L. Lauritsen, Hoffman Estates, Ill.

[73] Assignee: Eaton Corporation, Cleveland, Ohio

[21] Appl. No.: 25,450

[22] Filed: Mar. 2, 1993

[51] Int. Cl.[5] ..... H01H 9/00

[52] U.S. Cl. ..... 200/1 B; 200/315; 200/339

[58] Field of Search ..... 200/1 R, 1 B, 1 V, 5 R, 200/18, 1 A, 1 TK, 6 R, 6 B–6 C, 314, 315, 339; H01H 91/00

[56] References Cited

U.S. PATENT DOCUMENTS

| | | | |
|---|---|---|---|
| 4,105,882 | 8/1978 | Ulbing et al. | 200/1 V X |
| 4,152,563 | 5/1979 | Bongort | 200/1 B X |
| 4,314,111 | 2/1982 | Kobayashi | 200/339 X |
| 4,771,139 | 9/1988 | DeSmet | 200/5 A |
| 4,912,289 | 3/1990 | Lauritsen et al. | 200/1 R |
| 4,967,043 | 10/1990 | Killarney | 200/1 B |
| 5,089,715 | 2/1992 | Kokubu | 200/1 U X |
| 5,130,506 | 7/1992 | Zuercher et al. | 200/339 X |

*Primary Examiner*—J. R. Scott
*Attorney, Agent, or Firm*—Roger A. Johnston

[57] ABSTRACT

A switching assembly having some conductor strips molded in the base and extending outwardly to form connector terminals. Other conductive strips are disposed on the surface of the base and have the ends extending outwardly to also form connector terminals. The conductive strips have other portions bent upward to plug directly into a printed circuit board. A plurality of switches are mounted on the base and a switch is mounted on the circuit board directly above a base mounted switch. User movement of cover mounted rockers actuates the base mounted switches through push pins passing through clearance holes the circuit board. The circuit board mounted switch after user effected rocker actuation absorbs overtravel resulting from continued user movement of the rocker and is operative to move a sliding plunger in the circuit board to operate the base mounted switch directly below.

8 Claims, 2 Drawing Sheets

MULTIPLE CIRCUIT SWITCHING ASSEMBLY

BACKGROUND OF THE INVENTION

The present invention relates to switching assemblies of the type employed for user actuation of plural control functions from individual switch actuators. Examples of such devices are found in the switching assemblies employed for enabling user actuation of power lifted automotive windows and door locks where the user actuates an individual switch for the desired control function, such as moving a switch rocker in one direction for lowering the car window and in the opposite direction for raising the window. In such automotive accessory control applications, it has been desired to provide certain degrees of sophistication to the controls, such as, for example, the incorporation of an electronic circuit to enable the window lift motor to run continuously when initially energized for moving the window in the down direction without continued pressure on the switch actuator by the user. In such applications, it has therefore been desired to incorporate electronic control circuitry integral with the mounting for the individual control function switches.

In designing and manufacturing control switch assemblies for user control of plural electrical functions such as those encountered in automotive accessory switches, it has been desired to provide electronic control circuitry integral with the mounting of the plural switches to provide desired control functions for the accessories and to provide such a switch assembly that is compact, low in manufacturing cost, and easy to fabricate and assemble. In particular, it has been desired to provide such a switch assembly which is adapted for connection to a plural connector wiring harness as, for example, the type employed in automobile body wiring harnesses.

In certain applications for user operated function control switches, it has been desired to provide for actuation of plural switches by user movement of a single actuator in one direction. An example of this type of functional control is thus found in the automotive power winder lift switches where it is desired to provide what is known as an automatic or "express down" function. Normally, for manual operation the user moves the desired window lift control switch in one direction by a given amount and holds the actuator in this position to provide continuous operation of the window lift motor until the window is lowered to the desired position, whereupon pressure on the switch is released by the user. An automotive window lift switch equipped with an "express down" function enables the user to push the switch in the desired direction for lowering the window an additional amount of movement beyond the amount that is normally required to energize the motor, whereupon, a second switch is actuated, which signals an electronic controller, which permits the user to release the switch actuator; and, the motor continues automatically to lower the window to its lower limit.

Thus, it has been desired to find a way or means for providing a compact, easy to fabricate and assemble switching assembly, low in manufacturing coast, having user actuators for controlling plural functions and which includes electronic control of certain functions.

SUMMARY OF THE INVENTION

The present invention provides a switch assembly constructed with a molded base with conductive terminals embedded therein with portions extending outwardly for connection to an external connector, with other conductive strips mounted on the surface of the molded base, also with end portions extending outwardly for external connection. Secondary terminal strips are inserted in stanchions molded in the base for connecting to the strips embedded therein; and, a printed circuit board is assembled over the secondary terminals by bayonet-insert type connection thereto for connecting the printed circuit board to the terminal strips of the base.

Individual snap acting switches are disposed on the base and connected to the various terminal strips. At least one snap acting switch is mounted on the printed circuit board directly above one of the switches on the base. A plurality of rocker type actuators are disposed on the case mounted over the base and printed circuit board; and, upon user movement, the rockers move sliding pins which make contact with the various switches for effecting actuation thereof. In the case of the switch mounted on the printed circuit board, the rocker actuated pin causes actuation of the switch on the printed circuit board; and, continued movement of the rocker after actuation of the switch causes a slider mounted through the printed circuit board to actuate a switch mounted directly therebelow. The arrangement of the switch on the circuit board directly above the switch mounted on the base enables the user to effect actuation of the base-mounted switch by continued movement of the rocker in the same direction while actuating the switch on the printed circuit board. This arrangement permits energization of a specialized control function such as that required for "express down" actuation of an automotive window lift motor for lowering the window automatically to its full down position by a mere touch and release of the actuator by the user.

The other switches on the base are actuated by push pins from the rockers which pass through clearance holes in the printed circuit board.

The unique construction having some of the conductive strips molded in the base with others mounted thereon provides a compact and easy to fabricate assembly technique which permits a printed circuit board to be mounted directly thereon by plug-in connection, and assembly of the cover or case with actuating rockers and pins thereon in a compact low cost arrangement.

DETAILED DESCRIPTION

Figure 1:
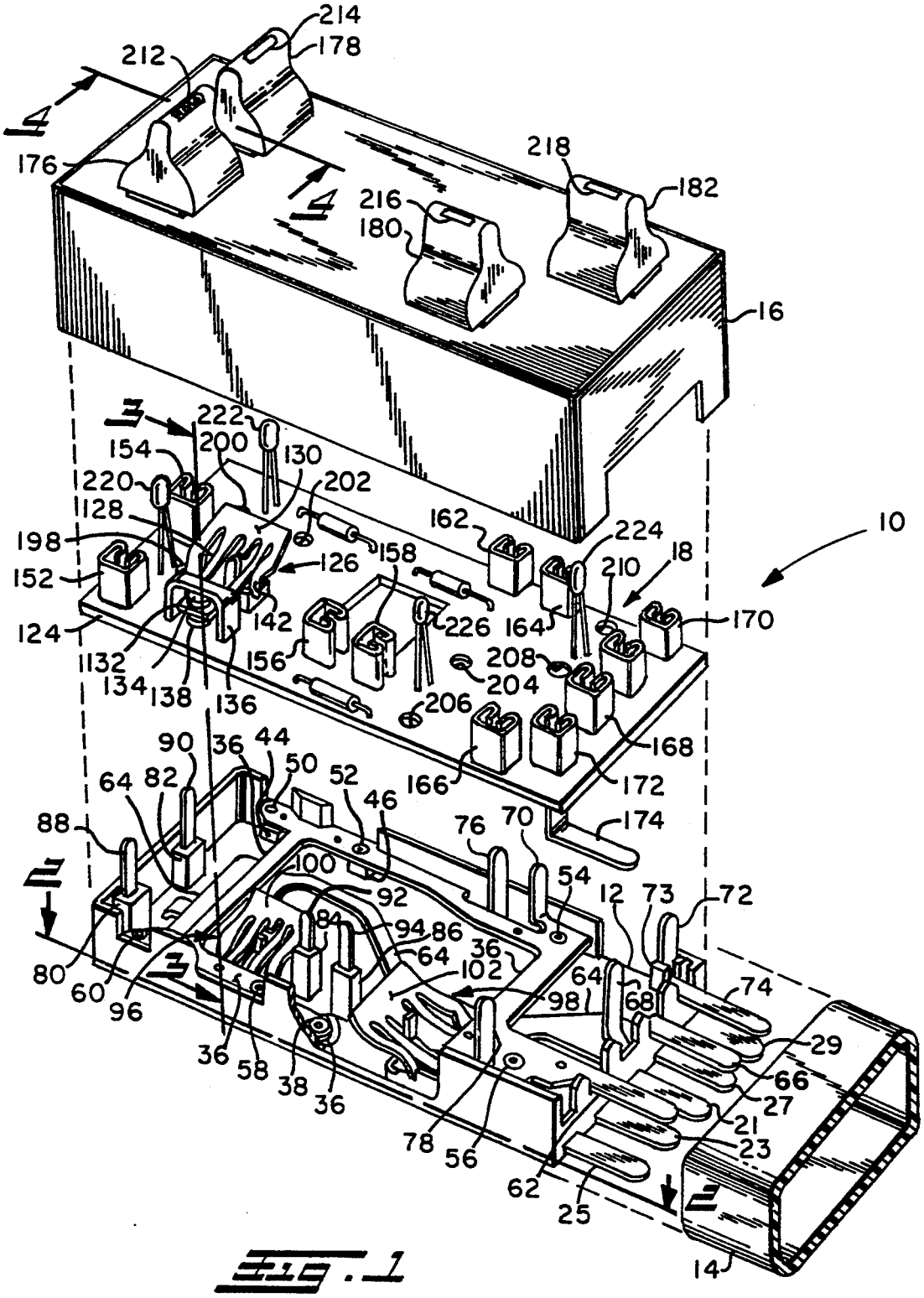
FIG. 1 is an exploded axonometric view of the switch assembly of the present invention.

Referring to FIG. 1, the switching assembly of the present invention is indicated generally at 10 as having the molded plastic base means which includes an integrally molded member 12 with a removable connector terminal shroud 14 provided on the end thereof. The base means also includes a removable cover or case 16 attached directly to the base member 12 by any suitable expedient as, for example, snap-locking tabs (not shown), as is well known in the art. A printed circuit board assembly is indicated generally at 18, and is attached to the base 12 as hereinafter described.

Figure 5:
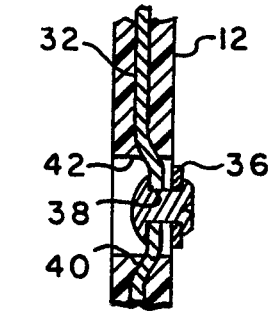
Figure 2:
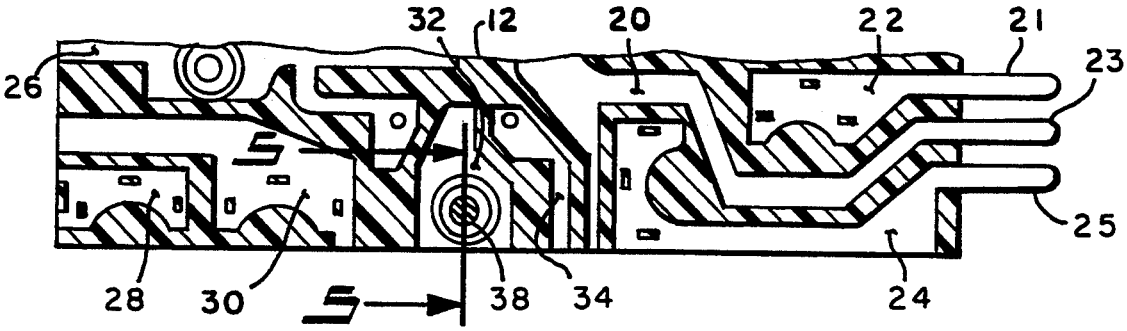
FIG. 2 is a portion of a section view, taken along section indicated lines 2—2 of FIG. 1.

Referring to FIGS. 1, 2, and 5, the molded plastic base member 12 has embedded therein a plurality of conductive strips denoted by reference numerals 20, 22, 24, 26, 28, 30, 32, and 34. It will be understood that the base 12 is truncated in FIG. 2 and that other, additional, terminal strips are embedded therein which are not shown. Each of the terminal strips 20,22,24 has an end portion thereof extending outwardly from the right hand edge of the base in FIG. 2 which are denoted respectively by reference numerals 21,23,25, and which are adapted for plug-in connection with a plural conductor wiring harness connector (not shown), as is well known in the art. The terminal strips 21,23,25 are disposed in generally parallel planar arrangement, along with other terminals 27,29, as is apparent from FIG. 1. Terminals 27 and 29 are end portions of strips not otherwise illustrated in FIG. 1 for clarity.

Referring to FIG. 5, the details of the attachment to terminal strip 32 by another strip 36, disposed at a level spaced above the base strips is attached to embedded strip 32 by rivet 34 received through an aperture 38 which is provided a dimpled portion 40 of strip 32, which is accessed through aperture or void 42 formed in the base. A portion of strip 36 and rivet 38 are visible in FIG. 1. The remaining portion of strip 36 is elevated or spaced from the base 12 by suitable stanchions, some of which are visible in FIG. 1, and are denoted by reference numerals 44,46 and which have raised portions thereof received through small apertures provided in the strip 46 and which have the strip secured thereto by heat staking. The heat stake portions are denoted by reference numerals 50, 52, 54, 56, 58, and 60 in FIG. 1.

An end portion 62 of strip 36 extends outwardly from the right hand end of the base 12 in spaced-parallel relationship with the lower row of terminals 25,23,21,27,29. Additional terminals disposed in parallel planar array with terminal 62 are provided by strip 64, which is disposed along the surface of base 12 with the end thereof denoted by reference numeral 66 offset and raised to extend outwardly from the right hand end of the base 12. Strip 64 also has tab or terminal portion 68 formed integrally therewith and bent vertically upward, as illustrated in FIG. 1 and denoted by reference numeral 68, and which is disposed adjacent the right hand end of base 12. Terminal strip 36 similarly has another intermediate portion formed integrally therewith and bent vertically upward to form thereon an additional connector terminal as shown in FIG. 1 and denoted by reference numeral 70, and which is disposed adjacent the rear edge of base 12.

A separate terminal strip 72 is formed generally at right angles with one end portion bent vertically upward and aligned with terminal 68, and which is denoted by reference numeral 72 in FIG. 1, with the remaining portion thereof disposed in line with, parallel to and spaced from terminal 66, as denoted by reference numeral 74 in FIG. 1. The terminal strip 72,74 is mounted in a slotted stanchion 73 formed integrally on base 12. It will be understood that the terminals 62, 66, and 74 are in parallel planar array forming an upper row from the lower terminals 25, 23, 21, and 27,29.

An additional vertically extending terminal 76 is provided extending upwardly from the surface of base 12, and is formed integrally with a portion of a strip disposed along the surface of base 12 (not shown in FIG. 1) and is spaced adjacent terminal 70. Similarly, an additional vertically-extending terminal strip 78 bends upwardly from a strip disposed on the surface of the base (not shown in FIG. 1) and is adjacent the front edge of base 12 in the region of terminal strip 62, as denoted by reference numeral 78.

Two sets of stanchions denoted respectively by reference numerals 80,82, and 84,86 are molded integrally with base 12, with one set 80,82 disposed along the left end of base 12 and the second set 84,86 disposed intermediate the ends thereof and spaced adjacent the front edge of the base. Each of the stanchions has inserted therein a terminal strip denoted respectively by reference numerals 88,90, and 92,94, and which extend vertically downwardly into the base 12. Terminals 88,90 make contact respectively with strips 28 and 30; and, terminals 92,94 make contact with strip 26 and 34 in the region of the strip 32.

The number of vertically-extending terminals is a function of the particular control circuitry employed. The vertical terminals illustrated in the drawings display the construction techniques employed; and, it will be understood that no attempt has been made to present any particular circuit arrangement or complete circuitry.

Referring to FIGS. I and 3, a plurality of snap acting switches are disposed on the base 12 to perform the desirable switching functions as desired. Two of such plurality of switches are illustrated typically in FIG. 1 and denoted generally by reference numerals 96,98, and have actuator portions of the snap acting blade mechanism denoted by reference numerals 100,102, respectively.

Figure 3:
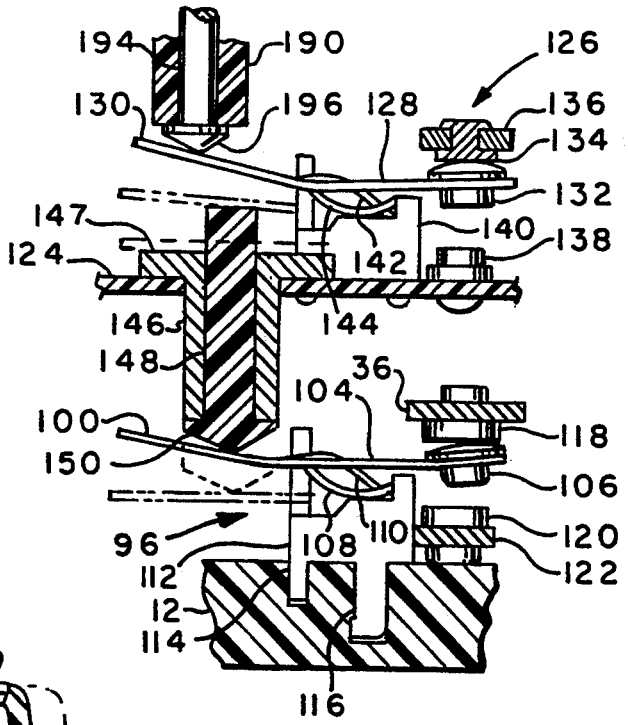
FIG. 3 is a portion of a section view, taken along section indicating lines 3—3 of FIG. 1.

Referring to FIG. 3, switch 96 is illustrated in greater detail as typical, and has the blade 104 thereof provided with the double sided movable contact 106. Blade 104 has spring tab portions 108, 110 secured on a rigid mounting stanchion 112, which has mounting portions thereof embedded in the base 12, as denoted by reference numerals 114, 116.

Switch 106 is actuated by movement of actuator end portion 100 of the blade 104 downwardly from the position indicated in solid outline in FIG. 3 to the position indicated in dashed outline. The movable double sided contact 106 is transferred from upper stationary contact 118, which is secured to conductive strip 36, by snap-action downwardly to make contact with lower stationary contact 120, which is mounted on one of the conductive strips disposed along the upper surface of base 12 and which is denoted by reference numeral 122 in FIG. 3.

Referring to FIGS. 1 and 3, the printed circuit board assembly 18 includes a board member 124 which has typically a printed circuit (not shown) provided on the bottom or underneath surface thereof for connection thereto, as will be subsequently described. The printed circuit board has a switch indicated generally at 126 mounted on the upper surface thereof, which switch is identical in construction to switches 96,98 mounted on the base 12. Switch 126 has a blade 128 movable for effecting snap actuation of a movable contact. The blade 128 has an actuator portion 130 provided on the end thereof and a double-sided contact 132 formed on the end of blade 128 opposite actuator 130, which contact 132 is transferable by snap actuation between an upper contact 134 mounted on a conductor strip 136 attached to the printed circuit board 124 and a lower contact 138 provided on the printed circuit board. Switch 126 also has a stanchion 140 mounted on the printed circuit board which supports the ends of spring tabs 142,144 connected to blade 128.

Printed circuit board 124 has a bushing 146 mounted therethrough with a flange 147 registered against the upper surface of the board, and which has a plunger or rod 148 slidably received therein, which has a button or head portion 150 provided on the lower end thereof which contacts the upper surface of the actuator 100 on the lower switch 96. The rod or plunger 148 extends upwardly a predetermined distance above the flange 147 of the bushing 146. It will be understood that rod 148 and button 150 are of insulating material to electrically isolate switch actuators 100 and 130.

Referring to FIG. 1, printed circuit board 124 has mounted thereon a plurality of metal sockets which coincide with slots or apertures (not shown) formed through the printed circuit board. A pair of metal sockets disposed to coincide with vertical terminals 88,90 are denoted by reference numerals 152,154 in FIG. 1; and, a pair of sockets denoted by reference numerals 156,158 are disposed to coincide with the vertical terminals 92,94 on the base. A third pair of metal sockets denoted by reference numerals 160,162 are provided on the printed circuit board and disposed to coincide in location with the vertically-extending terminals 76,70 extending upwardly from the base assembly. A plurality of sockets are disposed along the right hand edge of the printed circuit board to coincide in location with vertically-extending terminals 78, 68, and 72 as denoted by reference numerals 166, 168, and 170. An additional terminal socket denoted 172 is disposed at a station directly above terminal strip 25. Socket 172 has the vertical portion of a right angle terminal 174 received therein on the underside of the printed circuit board such that the terminal 174 is nested in the base spaced adjacent to and parallel with terminal 62. It will be understood that the arrangement of the various sockets is such that the printed circuit board assembly 18 may be plugged into the base by engagement of the various vertical terminals with the metal sockets at the respective locations. For example, terminals 88,92 plug into sockets 152,154. Terminals 84,86 plug into sockets 156,158; terminals 76,70 plug into sockets 162,164; terminals 78,68,72, respectively, plug into sockets 166,168,170. This arrangement thus permits ease of assembly of the assembled circuit board onto the base without the need for any soldering or crimping.

Figure 4:
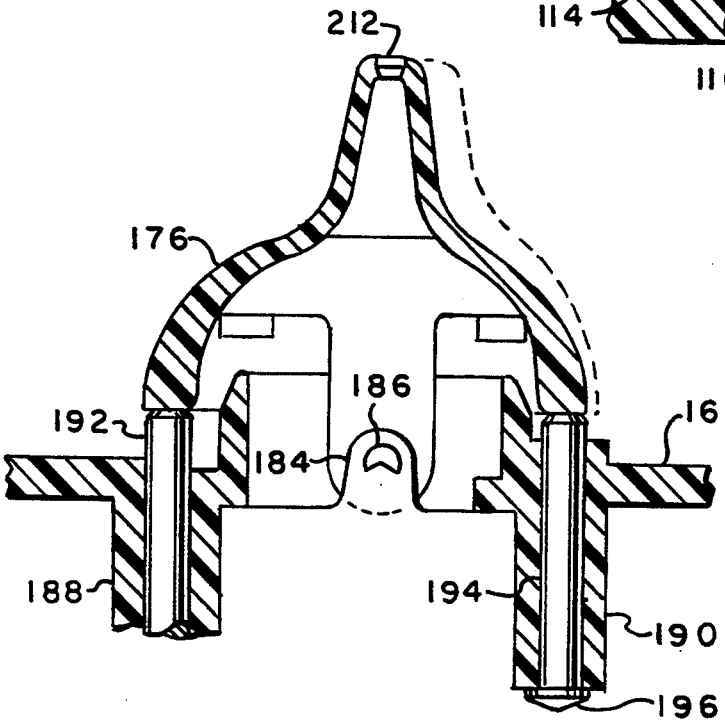
FIG. 4 is a portion of a section view, taken along section indicated lines 4—4 of FIG. 1; and, FIG. 5 is a section view, taken along section indicating lines 5—5 of FIG. 2.

Referring to FIGS. 1, 3, and 4, cover 16 has four switch actuator rockers denoted by reference numerals 176,178,180,182 which are each pivotally mounted on the cover 16.

Rocker 176 is pivoted on the cover 16 about a stanchion 184 molded integrally with the cover. Rocker 176, which has pivot tabs such as tab 186 illustrated in FIG. 4 extending through the stanchion for permitting pivotal movement of the rocker thereabout. The cover has a pair of downwardly-extending guides denoted by reference numerals 188,190 in FIG. 4; and, each of the guides has a plunger or rod slidably received therein and denoted by reference numerals 192,194, respectively. The lower end of each plunger has a button provided on the end thereof, as shown typically by button 196 provided on the lower end of rod 194 in FIGS. 3 and 4. It will be understood that each of the plungers 92,194 is located directly above the actuator portion of one of the switches. For example, as shown in FIG. 3, plunger 194 and its button 196 are disposed directly above actuator 130 of switch 126 for effecting actuation thereof. Because switch 126 is the only switch mounted on the printed circuit board, the guide 190 and plunger 194 are substantially shorter than the remaining plungers for each of the actuator rockers. The printed circuit board has a plurality of apertures denoted by reference numerals 198,200,202,204,206,208,210 which are formed through the printed circuit board to permit plungers such as plunger 192, which extends downwardly through aperture 198 to pass through the circuit board for actuation of the switches on the base. Thus, plunger 192 extends downwardly, as mentioned, through aperture 198 and the button (not shown) on the lower end thereof contacts the actuator of a switch (not shown) on the base. Similarly, pairs of plungers (not shown) associated with rocker 178 pass through apertures 200,202 for actuation of a pair of switches (not shown) on the base. The pair of plungers (not shown) also pass through apertures 206,204 in the printed circuit board to enable rocker 180 to actuate the pair of switches on the base, one of which is actuated by a plunger passing through aperture 206 to contact aperture 102 of switch 98. Likewise, a pair of plungers (not shown) extend downwardly from the cover to permit rocker 182 to actuate a pair of switches (not shown) by the plungers passing through apertures 208,210.

Each of the rockers 176,178,180,182 is hollow, and has provided therein a suitable translucent or transparent lens denoted respectively by reference numerals 212,214,216,218 as shown in FIG. 1. The lens 212 for the rocker 176 is also illustrated in FIG. 4.

The printed circuit assembly 18 also includes a plurality of light-emitting devices indicated by reference numerals 220,222,224,226, which are located thereon for each illuminating the hollow of one of the actuator. Upon assembly of the cover 16 over the printed circuit assembly 18 and attachment to the base 12, each of the light-emitting devices extends upwardly into the hollow portion of one of the rockers for providing illumination of the respective lens therein. Thus, with reference to FIG. 1, light-emitting device 220 is disposed to extend into rocker 176. Light-emitting device 222 extends upwardly into the interior of rocker 178 for illuminating lens 214; light-emitting device 224 extends upwardly into the interior of rocker 182 for illuminating lens 218; and, light-emitting 226 extends into the interior of rocker 180 for illuminating lens 216.

Referring to FIGS. 3 and 4, the operation of the switches will be described with respect to the two "stacked" switches, namely switch 128 mounted on the printed circuit board 124 and switch 126 mounted on the base 12.

Upon user movement of the rocker 176 in a clockwise direction about the pivot 186, or to the right with respect to FIG. 4 to the position indicated in dashed outline, the plunger 194 is moved downwardly.

Referring to FIG. 3, downward movement of plunger 194 causes the button 196 to move switch actuator 130 downwardly to the intermediate position shown in dashed outline, whereupon switch 126 snaps, causing transfer contact 132 to move downwardly to the stationary contact 138.

Upon continued user movement of the rocker 176 to the right with respect to FIG. 4, plunger 194 moves the actuator 130 an additional amount, to the position shown in the second or lower dashed outline, which causes the plunger 148 to move downwardly against switch actuator 100, causing switch 96 to toggle and snap transfer contact 106 downwardly against stationary contact 120. It will be understood that the switch actuator portion 130 of contact blade 128 thus absorbs the additional movement after switch 126 is actuated to permit movement of the plunger 148 for actuating switch 96. In one particular application of the switching assembly of the present invention, switch 126 is employed to operate an automotive window lift motor in a direction to lower the window; and, switch 96 is employed to provide a signal to circuitry mounted on printed circuit assembly 18 for providing continuous rotation of the window lift motor after the user releases pressure on the actuator rocker 176. In such an application, typically, switch 126 is wired for manual operation of the window lift motor such that the user must maintain rocker 176 in a position to cause switch 126 to maintain transfer contact 132 against contact 138 to continue rotation of the motor.

The present invention thus provides a unique and novel switching assembly of the type having plural individual, user-operated actuators for controlling desired accessory functions by actuation and de-actuation of switches contained in the assembly. The switching assembly has a molded base with a layer of conductive strips embedded therein, and a second layer disposed on the surface of the molded base for providing strips spaced from the first layer and which may be interconnected to various switches mounted thereon. Some of the strips have portions bent upwardly to provide vertically engageable contact terminals. Other portions of the strips extend outwardly of the base to provide terminals for connection to a multiple conductor wiring harness connector. A printed circuit board assembly plugs directly into the vertically-extending terminals to provide connection thereto. The printed circuit board assembly has at least one switch mounted thereon with sliding actuator rod or pin passing through and guided by a bushing on the circuit board between the circuit board mounted switch and one of the switches on the base. The switch housing cover has rocker type actuators for moving sliding pins guided for movement in the cover to actuate the switches mounted on the base through clearance apertures in the circuit boards. One of the rocker pins actuates the switch on the circuit board, which after actuation and absorbs overtravel of continued movement of the rocker and moves the pin bushed through the printed circuit board to actuate the switch directly below on the base. The present invention thus provides a simplified, easy-to-assemble switching assembly for providing plural switching functions and including electronic control circuitry thereon in a manner which is easily fabricated, assembled, and is low in manufacturing cost.

Although the present invention has been described with respect to the illustrated embodiments, it will be understood to those skilled in the art that modifications and variations may be made; and, the invention is limited only by the following claims.

We claim:

1. An electrical switching assembly comprising:

(a) housing means including a base member formed of molded insulating material and having at least one first level electrically conductive strip embedded therein with an end portion of said strip extending outwardly from the edge of said base member for connection thereto, said base member having portions thereof voided to expose intermediate portions of said strip enabling insert contact with said strip;

(b) at least one second level electrical strip disposed on the surface of said base member and having an end portion extending outwardly from the edge of said base member for connection thereto;

(c) at least one electrical switching means mounted on said base member and connected to said first and second level strips;

(d) actuator means mounted on said housing means and operable upon user movement for effecting actuation and de-actuation of said switch means.

2. The switch assembly defined in claim 1, further comprising: a circuit board; other portions of said strips extending generally at right angles thereto and inserted into said board for making electrical connection therewith; a second electrical switching means mounted on said board and disposed for actuation and de-actuation by said actuator means; and, a sliding member extending through said board and operable upon user continued movement of said actuator means after actuation of said second switching means to effect actuation of one of said at least one of said base mounted switching means.

3. The switch assembly defined in claim 2, wherein said at least one electrical switching means and said second electrical switching means are disposed in superposed relationship; and, said sliding member is guided by a bushing on said circuit board.

4. An electrical switching assembly comprising:

(a) housing means including a base member formed of molded insulating material and having a first and a second electrically conductive strip with an end portion of each strip extending beyond the edge of said base member, said end portion adapted for electrical connection thereto in bayonet fashion;

(b) first switching means mounted on said base member and connected to said first and second strip;

(c) circuit board means mounted on said base member in spaced superposed relationship;

(d) second switching means mounted on said circuit board means;

(e) actuator means movably mounted on said housing means and operable upon user movement thereof to effect actuation of said first switching means; and, (f) rod means extending through said circuit board means and movably mounted thereon, wherein said second switching means absorbs overtravel upon continued user movement of said actuator means after actuation of said second switching means, whereupon said rod means is moved by said second switching means and is operative to effect actuation of said first switching means.

5. The assembly defined in claim 4, wherein said base member is formed of plastic and one of said first and second conductive strips is molded and embedded in said base member and said embedded strip has other end portions thereof extending outwardly of said base member; and, said circuit board means is connected to said other end portions of said strip in bayonet-type insertion thereon.

6. The assembly defined in claim 4, wherein said rod means is slidably mounted through a bushing provided in said circuit board means.

7. The assembly defined in claim 4, wherein said switching means includes a snap-acting mechanism and said actuator means includes a pivoted member and push-pin between said pivoted member and said switching means.

8. The assembly defined in claim 4, wherein said actuator means includes a member mounted for pivotal movement on said housing means and having a window therein; and said circuit board means includes light emitting means for illuminating said window.

* * * * *